US010170264B2

(12) United States Patent
Mishra et al.

(10) Patent No.: US 10,170,264 B2
(45) **Date of Patent: *Jan. 1, 2019**

(54) INFORMATION DISPLAY SYSTEM FOR SWITCHING DEVICE, SWITCHING DEVICE, AND METHOD

(71) Applicant: ABB Schweiz AG, Baden (CH)

(72) Inventors: Ashish Mishra, New Britain, CT (US); Allison Stacey Conner, Brooklyn, NY (US); Piotr Slawomir Woronkowicz, Brooklyn, NY (US); Jung Soo Park, Brooklyn, NY (US)

(73) Assignee: ABB Schweiz AG, Baden (CH)

( * ) Notice: Subject to any disclaimer, the term of this patent is extended or adjusted under 35 U.S.C. 154(b) by 79 days.

This patent is subject to a terminal disclaimer.

(21) Appl. No.: 14/640,390

(22) Filed: Mar. 6, 2015

(65) Prior Publication Data

US 2016/0260569 A1 Sep. 8, 2016

(51) Int. Cl.

| | |
|---|---|
| ***H01H 71/04*** | (2006.01) |
| ***H01H 9/18*** | (2006.01) |
| ***H01H 71/02*** | (2006.01) |
| ***H01F 7/02*** | (2006.01) |
| *H01H 71/52* | (2006.01) |

(52) U.S. Cl.

CPC ..... *H01H 71/04* (2013.01); *H01F 7/02* (2013.01); *H01H 9/18* (2013.01); *H01H 71/025* (2013.01); *H01H 71/0264* (2013.01); *H01H 71/52* (2013.01); *H01H 2009/188* (2013.01); *H01H 2071/044* (2013.01)

(58) Field of Classification Search

CPC ..... H01H 71/04; H01H 71/02; H01H 9/16; H01F 7/02

USPC ..... 200/293

See application file for complete search history.

(56) References Cited

U.S. PATENT DOCUMENTS

| | | | |
|---|---|---|---|
| 2,021,499 | A | 11/1935 | Chubbuck et al. |
| 2,095,762 | A | 10/1937 | Peterson |
| D183,812 | S | 10/1958 | Schaus |
| 4,204,245 | A | 5/1980 | Luke et al. |
| 4,249,227 | A | 2/1981 | Kato et al. |
| 4,506,121 | A | 3/1985 | Peterson et al. |

(Continued)

FOREIGN PATENT DOCUMENTS

| | | | |
|---|---|---|---|
| AU | 2009202849 | A1 | 2/2010 |
| CN | 1925243 | A | 3/2007 |

(Continued)

OTHER PUBLICATIONS

European Search Report & Written Opinion issued in connection with EP Application No. 16158398.4 dated Jul. 22, 2016.

(Continued)

*Primary Examiner* — Renee Luebke
*Assistant Examiner* — Iman Malakooti
(74) *Attorney, Agent, or Firm* — Barnes & Thornburg LLP

(57) ABSTRACT

An information display system for a switching device includes a cover for the switching device, the cover including a first section and a second section, and a faceplate magnetically attracted to the cover and configured to carry information about the switching device, the faceplate further including an opening, at least a portion of the second section of the cover overlapped by the faceplate. The faceplate is adjustable with respect to the cover.

25 Claims, 7 Drawing Sheets

(56) References Cited

U.S. PATENT DOCUMENTS

| | | | | |
|---|---|---|---|---|
| 5,113,043 | A | 5/1992 | Morris | |
| 5,219,070 | A | 6/1993 | Grunert et al. | |
| 5,243,314 | A | 9/1993 | Maruyama | |
| 5,362,933 | A * | 11/1994 | Kutsche | H01H 71/0228 16/376 |
| 5,416,291 | A | 5/1995 | Venzke | |
| 5,504,285 | A | 4/1996 | Castonguay et al. | |
| 5,583,330 | A | 12/1996 | Fallah et al. | |
| 6,066,817 | A | 5/2000 | Flegel | |
| 6,080,947 | A | 6/2000 | Ulerich et al. | |
| 6,100,604 | A | 8/2000 | Morroni et al. | |
| 6,278,062 | B1 | 8/2001 | Sowdon | |
| D498,212 | S | 11/2004 | Kim | |
| D499,700 | S | 12/2004 | Raabe et al. | |
| 7,071,414 | B2 | 7/2006 | Kim | |
| D547,729 | S | 7/2007 | Azzola et al. | |
| 7,616,096 | B1 | 11/2009 | Sorensen | |
| D616,832 | S | 6/2010 | Corteel | |
| 8,004,377 | B2 | 8/2011 | Brusky et al. | |
| 8,230,629 | B2 | 7/2012 | Ashby et al. | |
| D735,143 | S | 7/2015 | Huhne et al. | |
| 2005/0109597 | A1 | 5/2005 | Etscheidt et al. | |
| 2005/0258921 | A1 * | 11/2005 | Puskar | H01H 71/0228 335/17 |
| 2007/0013380 | A1 | 1/2007 | Word | |
| 2008/0157906 | A1 | 7/2008 | Oh | |
| 2011/0056819 | A1 * | 3/2011 | Bower | H01H 71/0271 200/5 B |
| 2013/0195687 | A1 | 8/2013 | Achten et al. | |
| 2014/0130575 | A1 | 5/2014 | Webber et al. | |
| 2016/0260554 | A1 | 9/2016 | Hocine et al. | |
| 2016/0260560 | A1 | 9/2016 | Mishra et al. | |
| 2016/0260569 | A1 | 9/2016 | Mishra et al. | |

FOREIGN PATENT DOCUMENTS

| | | | |
|---|---|---|---|
| CN | 200995012 | Y | 12/2007 |
| CN | 101630599 | A | 1/2010 |
| CN | 202034311 | U | 11/2011 |
| CN | 102598188 | A | 7/2012 |
| DE | 19838431 | A1 | 3/2000 |
| EP | 0138513 | A2 | 4/1985 |
| EP | 0748015 | A1 | 12/1996 |
| FR | 2641933 | A1 | 7/1990 |
| FR | 2934094 | A1 | 1/2010 |
| WO | 2013151737 | A1 | 10/2013 |
| WO | 2013175236 | A2 | 11/2013 |

OTHER PUBLICATIONS

European Search Report and Opinion issued in connection with related EP Application No. 16158423.0 dated Jul. 21, 2016.

Restriction Requirement issued in connection with related U.S. Appl. No. 29/519,636 dated Nov. 16, 2016.

Non-Final Office Action issued in connection with related U.S. Appl. No. 15/057,178 dated May 10, 2017.

First Office Action issued in connection with related CN Application 201610127100.X dated Jul. 31, 2018 (18 pages, including translation).

* cited by examiner

INFORMATION DISPLAY SYSTEM FOR SWITCHING DEVICE, SWITCHING DEVICE, AND METHOD

BACKGROUND OF THE INVENTION

The subject matter disclosed herein relates to switching devices, and more particularly refers to an information display for a switching device.

Circuit breakers are switching devices widely used to protect electrical lines and equipment. Circuit breakers monitor current through an electrical conductor and "trip" to open the electrical circuit and thus interrupt current flow through the circuit provided that certain predetermined criteria are met, such as an over-current condition.

Circuit breakers include identifying and instructional information to indicate various features and ratings of the breaker, in order to properly select, install, and later identify a circuit breaker. Such information includes UL standard minimum requirements and suggested markings, as well as any additional information provided by circuit breaker manufacturers. While some of the information may be provided in any location except the back of the circuit breaker, other information must be visible on an installed circuit breaker with or without trims or covers removed. Information that must be visible on an installed circuit breaker, on an operator-visible portion of the breaker, is placed on a face of the circuit breaker. The reason for this requirement is that the information is necessary for the correct installation of the circuit breaker, having predetermined performance ratings and criteria, based on available electrical connections and intended use. Once the installation is complete, the information on the operator-visible portion of the circuit breaker is available for subsequent inspection at an orientation in which the circuit breaker is installed.

BRIEF DESCRIPTION OF THE INVENTION

According to one aspect of the invention, an information display system for a switching device includes a cover for the switching device, the cover including a first section and a second section, and a faceplate magnetically attracted to the cover and configured to carry information about the switching device, the faceplate further including an opening, at least a portion of the second section of the cover overlapped by the faceplate. The faceplate is adjustable with respect to the cover.

According to another aspect of the invention, a switching device includes a handle, a cover, and a faceplate. The cover includes a first section and a second section, the first section having a handle slot, the handle extended through the handle slot. The faceplate is magnetically attracted to the cover and configured to carry information about the switching device. The faceplate includes an opening, and at least a portion of the second section of the cover is overlapped by the faceplate.

According to yet another aspect of the invention, a method of displaying information on a switching device having a handle includes magnetically securing a faceplate to the switching device in a first position of the faceplate, the faceplate containing the information, the information oriented in a first orientation; rotating the faceplate with respect to the handle of the switching device; and, magnetically securing the faceplate to the switching device in a second position to re-orient the information in a second orientation different than the first orientation.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
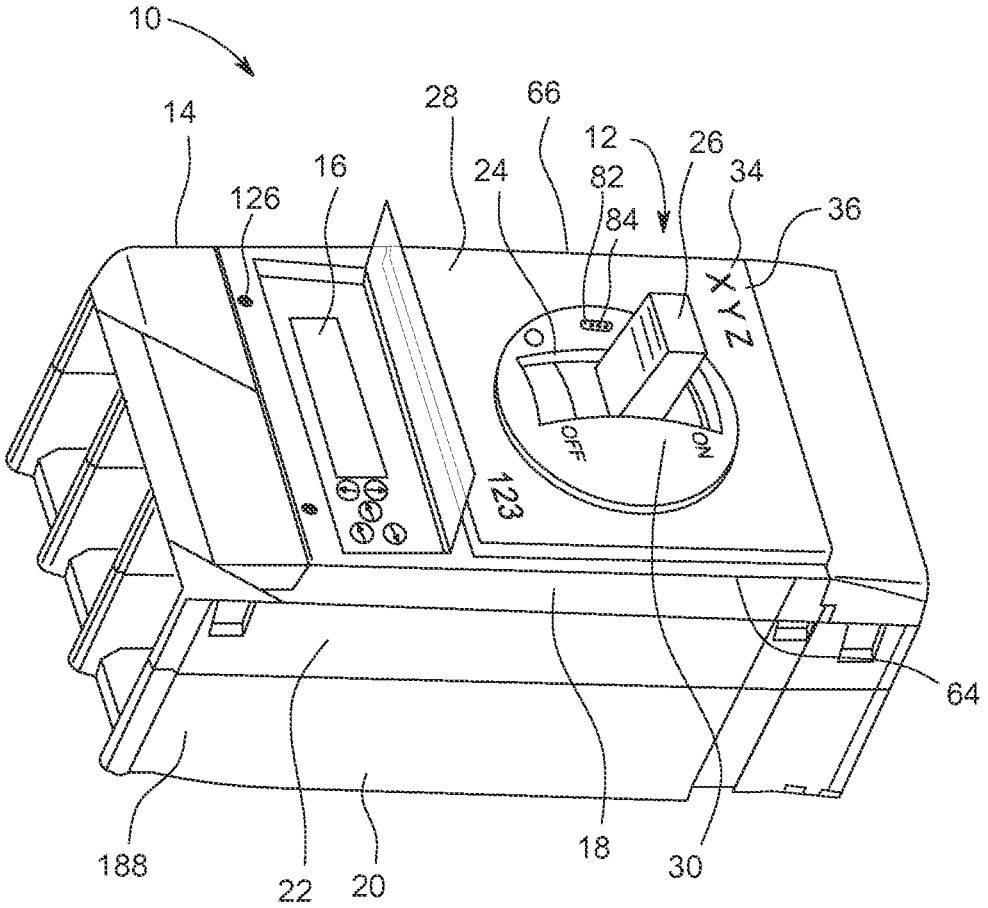
FIG. 1 is a perspective view of a switching device including an embodiment of an information display system.

FIG. 1 shows one embodiment of a switching device 10 that includes an embodiment of an information display system 12. The illustrated switching device 10 is a circuit breaker 14, although other switching devices may incorporate the information display system 12. While the circuit breaker 14 is illustrated as a 3 pole molded case circuit breaker ("MCCB") having a particular size and shape and as having available components 16 on a top cover 18, other types and sizes of circuit breakers 14 and switching devices 10 can advantageously employ the information display system 12, and the illustrated circuit breaker 14 is presented for illustrative purposes only. Also, while the circuit breaker 14 is illustrated as having a base 20 and a midcover 22 between the base 20 and cover 18, the midcover 22 and base 20 could alternatively be combined. The base 20, midcover 22, and cover 18 provide a housing 188 of the switching device 10. The cover 18 includes a handle slot 24 for allowing passage of a handle 26 of the circuit breaker 14. The cover 18 may be a separable cover 18 for removal from the base 20, such as for inspection or repair of internal components (not shown) of the circuit breaker 14. Internal components of the circuit breaker 14 may include, but are not limited to, a contact system having a set of fixed and movable contacts, movable contact arms supporting the movable contacts, an operating mechanism operating the movable contact arms, line and load straps supporting or electrically connected to fixed contacts, a current sensing unit, and arc chamber. In a normal "on" or closed condition of the circuit breaker 14, such as when the handle 26 is in the position shown in FIG. 1, the fixed and movable contacts are physically connected to each other. In an "off" or open condition of the circuit breaker 14, such as when the handle 26 is moved to an opposite side of the handle slot 24, the movable contacts are separated, such as via an opening spring, from the fixed contacts. The circuit breaker 14 thus makes or breaks the circuit based on current conditions, and may further carry rated current without over heating, provide adequate contact pressure and depression to keep the contacts closed in normal conditions, provide sufficient force to open the contact system with desired velocity during abnormal conditions, and provide dielectric isolation when contacts are in an open condition.

Figure 2:
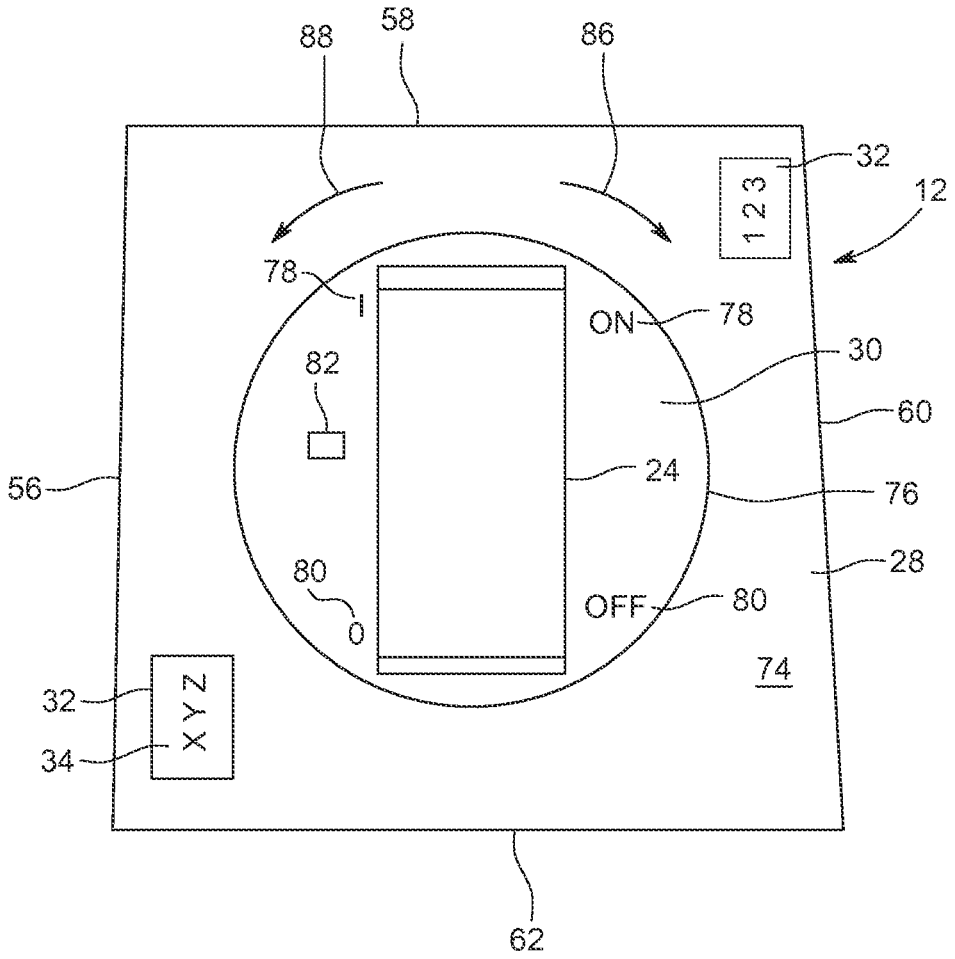
FIG. 2 is a plan view of the information display system of FIG. 1 with an embodiment of a faceplate of the information display system repositioned with respect to an embodiment of a cover of the information display system.
Figure 3:
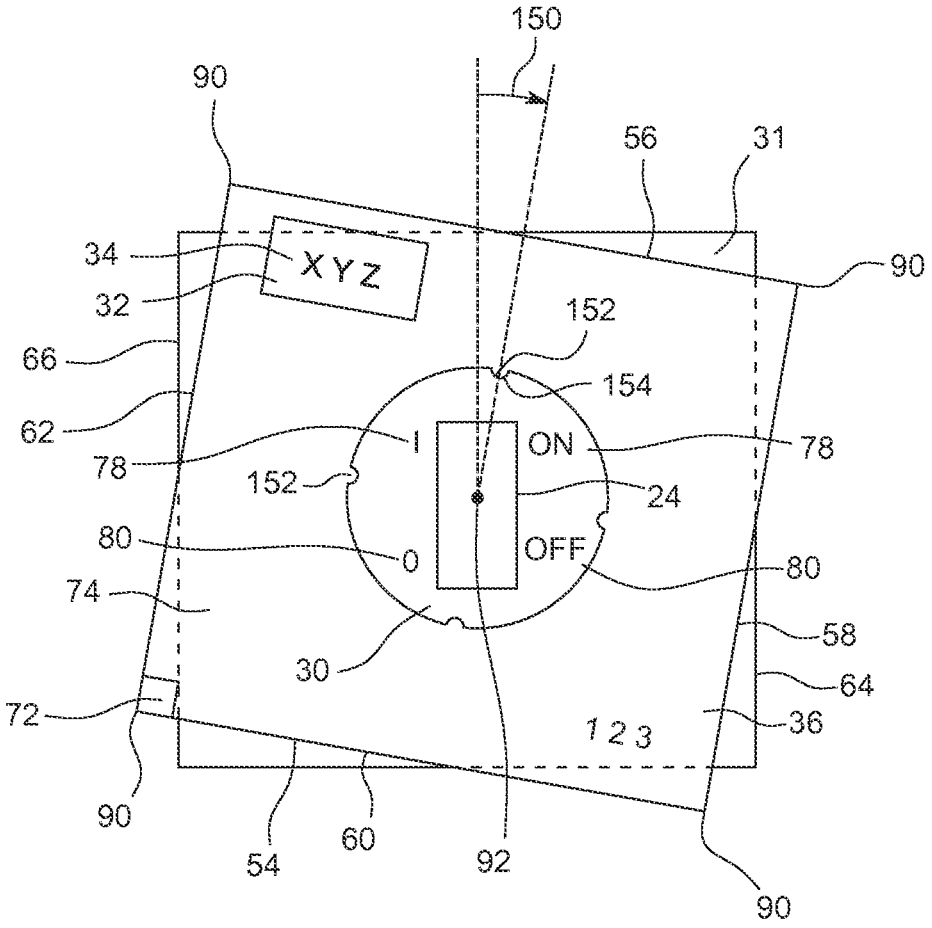
FIG. 3 is a plan view of the information display system of FIG. 1 with the faceplate in a non-rest position with respect to the cover.
Figure 4:
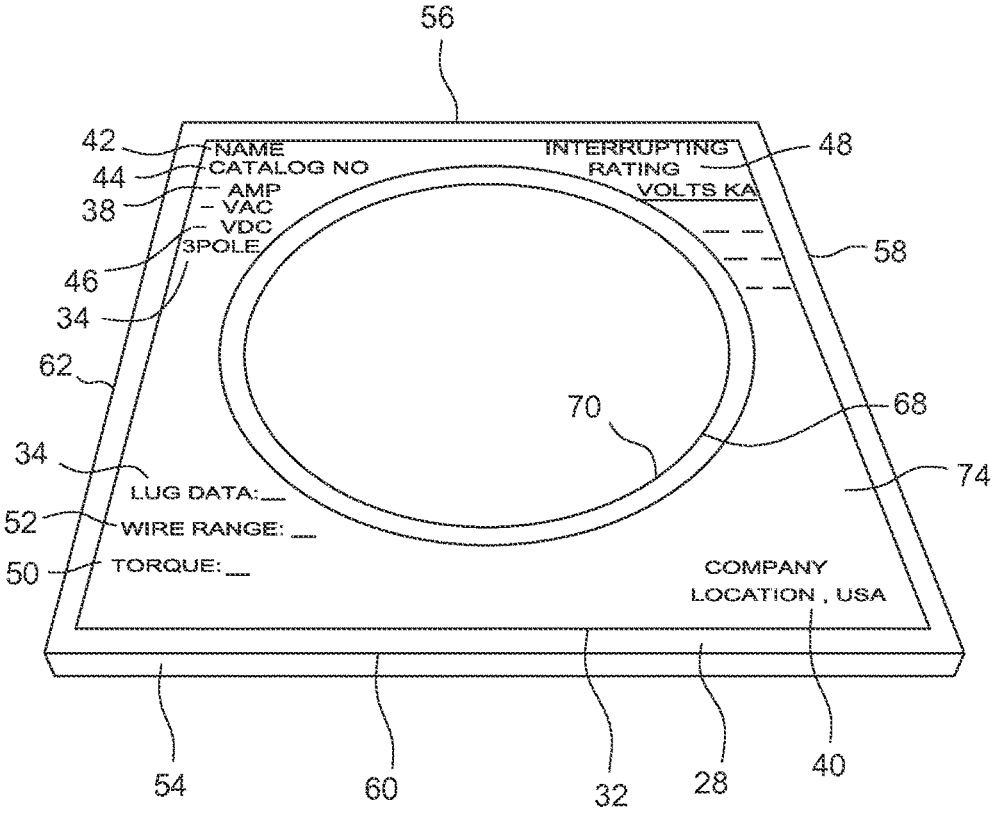
FIG. 4 is a perspective view of an exterior surface of the faceplate.

With further reference to FIG. 2, an embodiment of the rotatable information display system 12 is shown to include a faceplate 28 and the cover 18 or portion of the cover 18 of the circuit breaker 14. The cover 18 includes a first section 30 that may be integrally connected to the cover 18, although alternatively the first section 30 may be a separate element that is attached to the cover 18 during assembly. A remainder of the cover 18 includes a second section 31 (FIGS. 1 and 3). As the first section 30 and second section 31 are fixedly attached to each other, the cover 18 includes both the first section 30 and the second section 31. The faceplate 28 is an information carrier. The faceplate 28 may be configured to support one or more labels 32 as shown in FIGS. 2, 3, and 4 having the information 34, such as but not limited to an adhesive label, or alternatively the faceplate 28 may include information provided directly thereon, such as printed, inscribed, stamped, or etched on the faceplate 28 such as in areas 36, as shown in FIGS. 1 and 3. In yet another alternative embodiment, the faceplate 28 may include a combination of one or more labels 32 and information 34 provided directly thereon, such as demonstrated by FIG. 3. The information 34 provided on the faceplate 28 contains information about the switching device 10 used for operation, installation and inspection of the switching device 10. With reference to FIG. 4, as applicable, when the switching device 10 is a circuit breaker 14, depending on the type and rating of the circuit breaker 14, information 34 provided on the faceplate 28 for the circuit breaker 14 may include, but is not limited to, ampere rating 38, manufacturer identification 40, breaker type designation 42, a catalog number 44, voltage rating 46, SWD designation, HID designation, maximum ambient temperature in which the circuit breaker can be applied, Class CTL (circuit limiting), line and load designation, interrupting ratings 48, termination (Cu—Al wire), tightening torque 50, wire temperature ratings 52, maximum wire size, 100% rating marking, and fault protection information (ground fault protection for people GFCI, ground fault protection for equipment GFPE, and arc-fault protection AFCI), some of which is shown in FIG. 4 for illustrative purposes. In addition to data and details regarding the switching device 10, installation and operating instructions, company trademarks, safety information, scannable code, and any other relevant information may be provided as the information 34 on the faceplate 28. The information 34 is fixed in orientation with respect to the faceplate 28, such that as the faceplate 28 rotates, so does the information 34.

In an embodiment of the faceplate 28, the faceplate 28 includes a square-shaped outer periphery 54 having outer peripheral edges 56, 58, 60, 62 and a width that may be substantially the same as a width of the cover 18, measured from two opposite sides 64, 66 (FIGS. 1 and 3) of the cover 18, however different widths of the faceplate 28 may also be accommodated. The faceplate 28 includes an opening 68 having an inner periphery 70 that may be at least substantially circular, and a diameter of the inner periphery 70 may be approximately the same as an outer diameter of an outer periphery 76 of the first section 30, although differences in diameter between the inner periphery 70 of the faceplate 28 and the outer diameter of the first section 30 may be made for clearance and relative positioning purposes, as will be further described below. The faceplate 28 includes a thickness that may be selected to allow grasping by an operator. Alternatively or additionally, the faceplate 28 may include one or more easily graspable protrusions 72 extending from edges 56, 58, 60, 62 of the faceplate 28 or from an exterior surface 74 of the faceplate 28, although such protrusions 72 should not interfere with the provision of an information-containing label 32 or information 34 provided directly on the faceplate 28.

The first section 30 includes the handle slot 24 that may be substantially rectangular shaped, however any size aperture that allows the handle 26 to move from an on to an off position of the circuit breaker 14 can be provided as the handle slot 24. On-off indicators 78, 80 may be provided on the first section 30 adjacent the handle slot 24. The first section 30 further includes a circular, or at least substantially circular, outer periphery 76. As noted above, the outer periphery 76 may have approximately the same diameter as that of the inner periphery 70 of the faceplate 28. The first section 30 may further include a push-to-trip button hole 82 to access a push-to-trip button 84 (FIG. 1), such as to test the circuit breaker 14 mechanically. The first section 30 is rotationally fixed with respect to the cover 18, and as illustrated, is integrally connected to the cover 18 in a one-piece cover 18 for ease in assembly. Thus, as the faceplate 28 is adjusted with respect to the cover 18, the faceplate 28 adjusts with respect to both the cover 18 and the first section 30 simultaneously. For reduction of parts, the cover 18 of the information display system 12 shown in FIG. 2 is the same cover 18 of the switching device 10 of FIG. 1. While only a square portion of the cover 18 is shown in FIG. 2, the cover 18 may take on any lengths necessary to properly cover a base 20 and contain internal components of the circuit breaker 14, including the rectangular cover shape shown in FIG. 1. Alternatively, a cover 18 of a switching device 10 may include the square portion shown in FIG. 2 and additional portions as needed to form a whole cover for the switching device 10. In yet another alternative embodiment, the information display system 12 of FIG. 2 may be added to an existing cover of a switching device 10.

With reference to FIG. 2, in an embodiment of the information display system 12, the faceplate 28 may be adjusted in either a clockwise direction 86 or a counterclockwise direction 88 with respect to the first section 30 and cover 18. As can be readily appreciated, the ability to adjust the faceplate 28 provides an installer and operator with the opportunity to turn the faceplate 28 to an orientation that provides the installer and operator greatest ease in reading the information 34 contained thereon, regardless of the orientation of the remainder of the installed switching device 10. For demonstrative purposes only, information 34 on the faceplate 28 shown in FIG. 1 is in a first orientation, while the same information 34 is shown in FIG. 2 in a second orientation, different than the first orientation, due to movement of the faceplate 28 with respect to the cover 18 and first section 30. The second orientation is 90 degrees counterclockwise from the first orientation, or 270 degrees clockwise from the first orientation.

Further, with respect to adjustment of the faceplate 28, the faceplate 28 may include features, as will be further described below, that limit repositioning of the faceplate 28 on the cover 18 to a selected number of rest positions, such as four rest positions at 90 degree increments. By limiting rest positions of the faceplate 28 to 90 degree increments, at least two of the outer peripheral edges, either opposite edges 58 and 62 or opposite edges 56 and 60, of the faceplate 28 remain aligned and substantially parallel with the opposite sides 64, 66 of the switching device 10, as shown in FIG. 1. For example, in a first rest position, such as shown in FIG. 1, edge 58 of faceplate 28 is adjacent side 64 of cover 18, in a second rest position, such as shown in FIG. 2, edge 60 of faceplate 28 is adjacent side 64 of cover, in a third rest position, edge 62 would be adjacent side 64 of cover 18, and in a fourth rest position, edge 56 would be adjacent side 64 of cover 18. In a non-rest position, such as shown in FIG. 3, while moving the faceplate 28 from one rest position to the next, corners 90 of the faceplate 28 may protrude outwardly from the opposite sides 64, 66 of the switching device 10. The rest positions avoid this by aligning the outer peripheral edges 56 and 60 or 58 and 62 with opposite sides 64, 66 of the switching device 10 when the features are aligned at any of the rest positions of the faceplate 28. While a square faceplate 28 has been described, the faceplate 28 may include any number of outer peripheral edges with corresponding additional features to limit repositioning to a greater number of rest positions. For example, the faceplate 28 may include an octagonally shaped outer periphery (not shown) and features may limit repositioning to every 45 degrees, and thus such an embodiment would increase the number of possible rest positions for the faceplate 28 to eight while still aligning two edges of the faceplate 28 with opposite sides 64, 66 of the switching device 10. The information display system 12 is not limited with respect to a particular number of rest positions or number of outer peripheral edges of the faceplate 28. Although not conventional, the faceplate 28 may even include rounded outer peripheral edges. In any case, the orientation of the information 34 provided on the faceplate 28 is alterable to ease a user's review of the information 34.

For the purposes of description of one embodiment of the faceplate 28 herein, the faceplate 28 will be described as having rest positions at 90 degree increments. Multiples of a 90 degree movement of the faceplate 28 with respect to the cover 18 reposition the faceplate 28 to accommodate horizontal and vertical installation orientations of the switching device 10 in a switching device panel. Manually turning the faceplate 28 of the switching device 10 90 degrees in either direction 86, 88, or 180 degrees clockwise or counter clockwise around a longitudinal axis 92 of the first section 30 (extending perpendicularly into FIG. 3 and about a center point of faceplate 28), reorients the information 34 to match the installation orientation. This movement will be powered by the user and is facilitated by features under the faceplate 28 that correspond with the cover 18, as will be further described below. With this repositionable faceplate 28, the installer can adopt the information orientation to both vertical and horizontal installations and retrieving information from the label 32 and faceplate 28 becomes user friendly.

Figure 5:
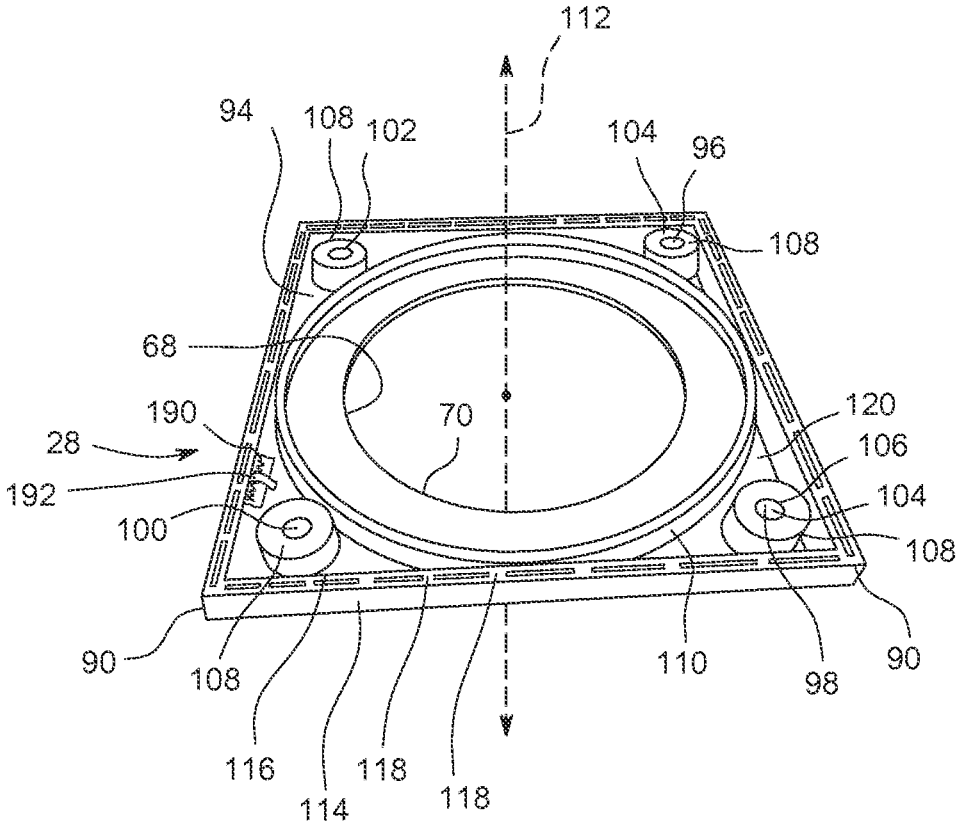
FIG. 5 is a perspective view of an interior surface of the faceplate.

The exterior surface 74 of the faceplate 28 is sized for accepting the information 34 thereon. The interior surface 94, opposite the exterior surface 74, of the faceplate 28 is depicted in FIG. 5. The faceplate 28 includes the opening 68 with the inner periphery 70 having at least a substantially circular shape. The faceplate 28 further supports at least one faceplate ferromagnetic element 104, and in the illustrated embodiment the faceplate 28 includes first, second, third, and fourth faceplate ferromagnetic elements 96, 98, 100, 102. When one or more of the faceplate ferromagnetic elements 104 is magnetized to be permanent magnets, then the faceplate ferromagnetic elements 104 are faceplate magnets 106. The faceplate ferromagnetic elements 104 are provided on the interior surface 94, however alternatively the faceplate 28 may include faceplate ferromagnetic elements 96, 98, 100, 102 on the exterior surface 74 if the material of the faceplate 28 between the exterior surface 74 and the interior surface 94 is of a thickness that allows the faceplate ferromagnetic elements 96, 98, 100, 102 to experience magnetic attraction therethrough, and if the positioning of the faceplate ferromagnetic elements 96, 98, 100, 102 does not interfere with the placement of information 34 on the exterior surface 74. In the illustrated embodiment, the interior surface 94 includes receiving areas 108, such as pockets, for receiving the faceplate ferromagnetic elements 104. While pockets are depicted, any receiving structure could be included for receiving the faceplate ferromagnetic elements 104 on the interior surface 94. For example, the faceplate ferromagnetic elements 104 may simply be adhered or otherwise affixed to the interior surface 94. In the illustrated embodiment, the receiving areas 108 are located adjacent corners 90 of the faceplate 28.

With reference to FIG. 5, an interior ledge 110, having at least a substantially circular shape as shown, may be further provided on the interior surface 94, and operatively arranged for guiding movement of the faceplate 28 with respect to the cover 18 as will be further described below, although in an alternative embodiment the interior ledge 110 is not included. In the illustrated embodiment, the interior ledge 110 is disposed radially outwardly of the inner periphery 70, that is, further from an axis of rotation 112 of the faceplate 28. The interior ledge 110 extends from the interior surface 94, such as substantially perpendicular from the interior surface 94, although in alternate embodiments the interior ledge 110 may extend at different non-zero angles from the interior surface 94. The faceplate 28 further includes an outer ledge 114 extending from the interior surface 94, and spaced outwardly from the interior ledge 110. The outer ledge 114 may extend along the outer periphery 54 of the faceplate 28 as shown. Support walls 116 may also be located on the interior surface 94, extend from the interior surface 94, and interiorly follow the outer ledge 114 of the faceplate 28, with support connectors 118 attached to the support walls 116 and outer ledge 114. The receiving areas 108 are positioned between the interior ledge 110 and the corners 90, and more particularly may be positioned between the interior ledge 110 and the support walls 116. The interior ledge 110, outer ledge 114, and support walls 116 may have a uniform height, and in an alternative embodiment any of the spaces 120 defined between the interior surface 94, the outer ledge 114, and the inner periphery 70 may be filled in with material, such as the same material used to form the faceplate 28, including but not limited to plastic. The space 120 may also be employed to store information 34, such as information 34 provided on a material 190, such as a folded piece of paper, leaflet, or instruction sheet that may be secured within the space 120 via a fastener 192, such as, but not limited to, a biased clip and a snap pocket. The material 190 may be a spare instruction sheet storable in the space 120 so that if a customer is in search of any sort of additional information 34 not otherwise provided on the exterior surface 74 of the faceplate 28, then the faceplate 28 can be removed from the switching device 10 to access the material 190. The interior surface 94 of the faceplate 28 may also be used for receiving any other information 34 as desired. Also, while a particular webbed arrangement of ledges 110, 114, and support walls 116 is illustrated, the interior surface 94 may alternatively include additional or alternate webs to promote structural stability of the faceplate 28.

Figure 6:
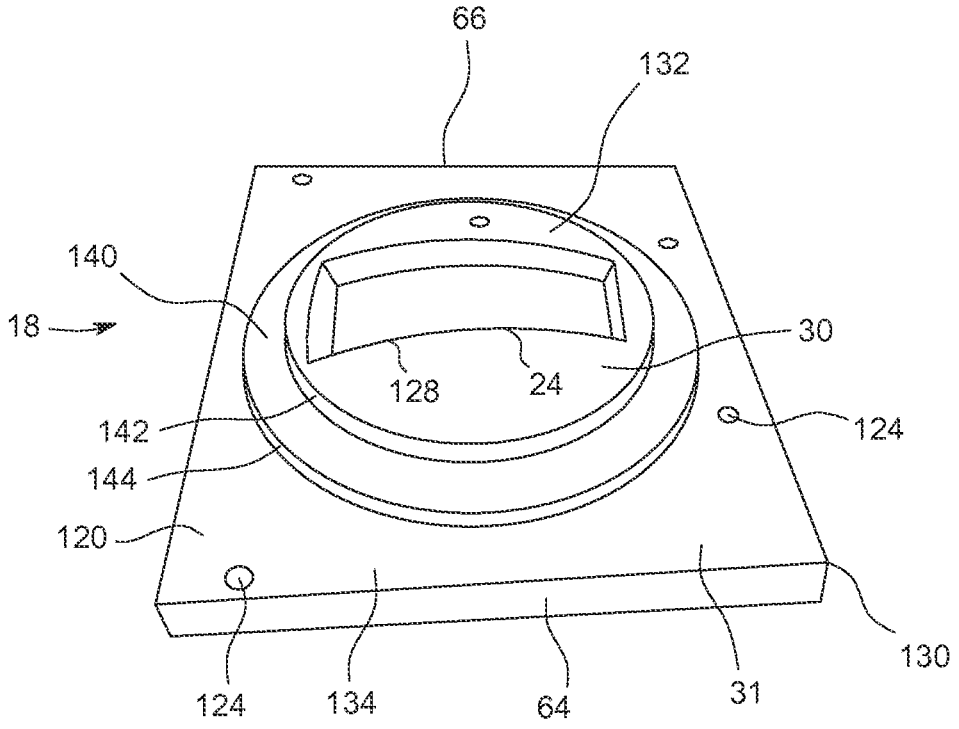
FIG. 6 is a perspective view of an exterior surface of the cover.

An exterior surface 122 of the cover 18 is shown in FIG. 6. The cover 18 may include holes 124 for securement devices 126 (FIG. 1), such as screws, to be passed therethrough in order to secure the cover 18 to the base 20 (or to the mid cover 22, or to another cover) of the switching device 10. When assembled, the interior surface 94 of the faceplate 28 faces the exterior surface 122 of the cover 18, and the interior ledge 110 and outer ledge 114 of the faceplate 28 extend towards the cover 18. The cover 18 includes an inner periphery 128, corresponding to the handle slot 24 in the first section 30 of the cover 18, and an outer periphery 130 having first and second opposite sides 64, 66. The cover 18 includes at least a first portion 132 corresponding to the first section 30 and a second portion 134 corresponding to the second section 31 of the cover 18 containing cover ferromagnetic elements 136 (FIG. 7), one or more of which may be cover magnets 138. The cover 18 may further include a third portion 140, as will be further described below, between the first and second portions 132, 134. The cover 18 further includes a first shoulder wall 142 defining an outer periphery of the first section 30. The first shoulder wall 142 may be substantially cylindrically shaped and may at least substantially correspond in size with the inner periphery 70 of the faceplate 28. That is, the first shoulder wall 142 has a diameter substantially the same as the diameter of the inner periphery 70 of the faceplate 28, although the diameter of the first shoulder wall 142 may be smaller than the diameter of the inner periphery 70 of the faceplate 28 for clearance. The first portion 132 of the cover 18, corresponding to the first section 30, contains the handle slot 24 and extends to the first shoulder wall 142. The first portion 132 may be dome shaped as illustrated, or alternatively may be substantially planar. The first portion 132 may further include the push-to-trip button hole 82. When the faceplate 28 includes the interior ledge 110 as described above, the cover 18 may further include a second shoulder wall 144 spaced radially outwardly of the first shoulder wall 142, where the second shoulder wall 144 is concentric with the first shoulder wall 142. The second shoulder wall 144 has a diameter substantially the same as the diameter of the interior ledge 110 of the faceplate 28, although the diameter of the second shoulder wall 144 may be slightly smaller that the diameter of the interior ledge 110 to provide clearance for the interior ledge 110 to overlap the second shoulder wall 144 during assembly and rotation of the faceplate 28 with respect to the cover 18. The third portion 140 of the cover 18 extends between the first shoulder wall 142 and the second shoulder wall 144. The third portion 140 may be substantially planar, although other surfaces can be incorporated. The second portion 134 between the second shoulder wall 144 and the outer periphery 130 of the cover 18 may also be substantially planar or include other surfaces. The second shoulder wall 144 protrudes outwardly from the second portion 134, and the first shoulder wall 142 protrudes outwardly from the third portion 140, with respect to the exterior surface 122 of the cover 18. Thus, a height of the cover 18 at the first portion 132 is greater than a height of the cover 18 at the third portion 140, and a height of the cover 18 at the third portion 140 is greater than a height of the cover 18 at the second portion 134. While the second shoulder wall 144 provides additional guidance for movement of the faceplate 28 with respect to the cover 18, in an alternative embodiment the cover 18 does not include the second shoulder wall 144, in which case the second portion 134 of the cover 18 extends from the outer periphery 130 of the cover 18 to the first shoulder wall 142. In either case, the first section 30 of the cover 18 protrudes from the second section 31 of the cover 18.

Figure 7:
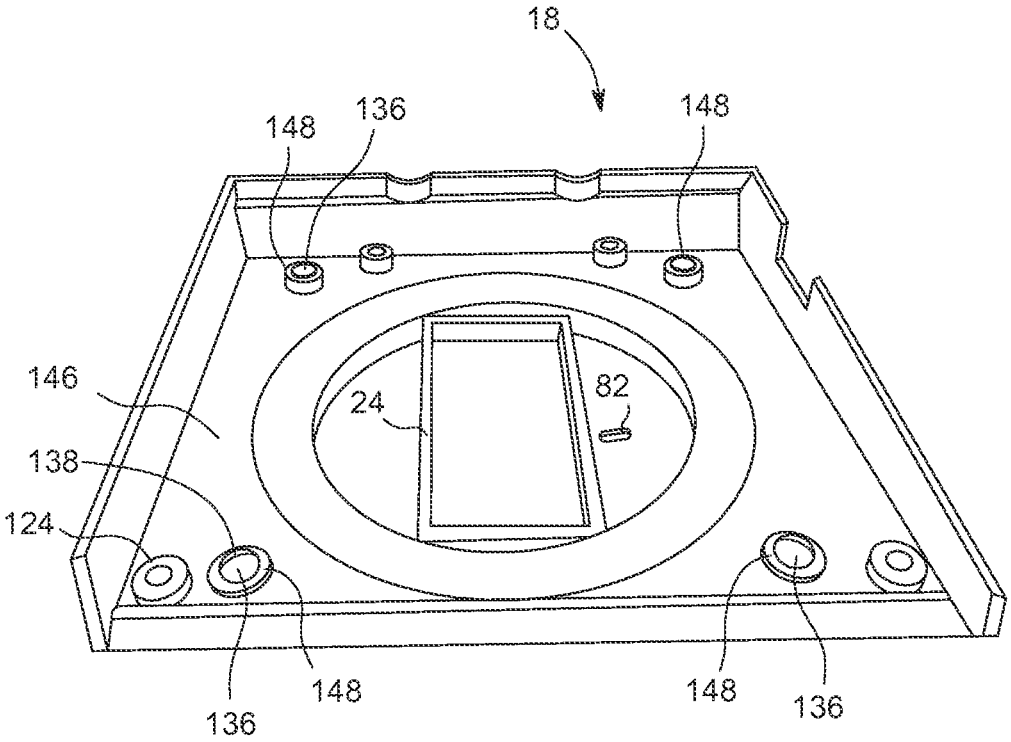
FIG. 7 is a perspective view of an interior surface of the cover.

FIG. 7 depicts an interior surface 146 of the cover 18. Cover ferromagnetic elements 136 are positioned on the cover 18 at locations that will correspond to locations of the faceplate ferromagnetic elements 104 when the faceplate 28 is arranged on the cover 18 in any one of the rest positions of the faceplate 28 with respect to the cover 18. In the illustrated embodiment, the faceplate includes four rest positions, where a first rest position is shown in FIG. 1, and a second rest position is shown in FIG. 2, and the second rest position is offset 90 degrees in a counterclockwise direction from the first rest position. It can be understood that a third rest position of the faceplate 28 is offset 180 degrees from the first rest position, and a fourth rest position of the faceplate 28 is offset 90 degrees in a clockwise direction from the first rest position the faceplate 28. The cover ferromagnetic elements 136 are positioned on the interior surface 146 of the cover 18, corresponding to the second portion 134 of the cover 18. While placing the cover ferromagnetic elements 136 on the interior surface 146 of the cover 18 protects the cover ferromagnetic elements 136 from dislodgement, in alternative embodiments, the cover ferromagnetic elements 136 may be positioned on the exterior surface 122 of the cover 18. With reference to the illustrated embodiment, the interior surface 146 may include receiving areas 148, such as pockets, to receive the cover ferromagnetic elements 136. While pockets are depicted, any receiving structure could be included for receiving the cover ferromagnetic elements 136 on the interior surface 146. For example, the cover ferromagnetic elements 136 may simply be adhered or otherwise affixed to the interior surface 146 of the cover 18. The receiving areas 148 are located on the second portion 134 of the cover 18. The material of the cover 18, such as but not limited to plastic, and thickness of the cover 18 in the second portion 134 enable the cover ferromagnetic elements 136 to be magnetically attracted from the exterior surface 122 of the cover 18 to the faceplate ferromagnetic elements 104. For magnetic attraction to occur, either or both of the faceplate ferromagnetic elements 104 and cover ferromagnetic elements 136 are permanent magnets, such as faceplate magnets 106 and cover magnets 138. In one embodiment, the information display system 12 includes both faceplate magnets 106 and cover magnets 138 having opposite poles, which provides advantages including sufficient faceplate retention strength and faceplate removal assistance as will be further described below. In one embodiment, the number of cover ferromagnetic elements 136 is the same as the number of faceplate ferromagnetic elements 104, and in the illustrated embodiment the number is four. However, the number of faceplate ferromagnetic elements 104 may be different than the number of cover ferromagnetic elements 136 and still provide the same number of rest positions for the faceplate 28. For example, the information display system 12 could include one faceplate ferromagnetic element 104 and four cover ferromagnetic elements 136, or alternatively the information display system 12 could include four faceplate ferromagnetic elements 104 and one cover ferromagnetic element 136, and the information display system 12 could still be provided with four magnetic rest positions of the faceplate 28 on the cover 18 in either embodiment.

Figure 8:
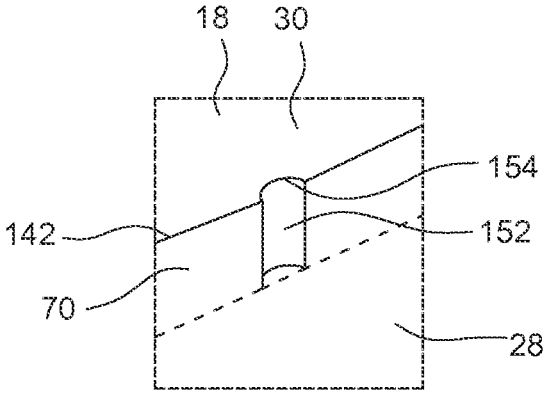
FIG. 8 is a perspective view of a portion of an embodiment of a retention and release feature of the information display system.

When the information display system 12 includes both faceplate magnets 106 and cover magnets 138, the faceplate 28 is magnetically attracted to the cover 18 in any one of the rest positions of the faceplate 28, and easily removed with a small amount of rotation of the faceplate 28 with respect to the cover 18, for example about 5 to 7 degrees. The amount of degree change may vary depending on the size of the magnets 106, 138. When the faceplate magnets 106 have opposite poles from the magnets 138, the faceplate 28 will orient onto the cover 18 at any one of the rest positions. However, since each magnet 106, 138 has attraction at its center but repels at the edges thereof (edge polarity changes), when the faceplate 28 is turned in either direction 86, 88 with respect to the cover 18 and about the axis of rotation 112 for the set number of degrees 150 (FIG. 3), the magnets 106, 138 will repel each other and the faceplate 28 can be removed with practically no effort from the user. In an alternative embodiment, as shown in FIGS. 3 and 8, the inner periphery 70 of the faceplate 28 includes one or more protrusions 152. In the rest positions of the faceplate 28, such as when two of the edges 56, 58, 60, 62 are aligned with the opposite sides 64, 66 of the cover 18, the one or more protrusions 152 will have a positive force acting on the first shoulder wall 142 of the first section 30 due to interference. The cooperation between the protrusions 152 and the first shoulder wall 142 are radially force exerted by the protrusions 152 on the first shoulder wall 142 may provide extra retention of the faceplate 28 with respect to the cover 18 when in the rest position. The first shoulder wall 142 may further include detents 154 such that when the faceplate 28 is rotated the set number of degrees 150, the protrusions 152 radially seat within the negative detents 154 and the repulsion force between the magnets 106, 138 can easily force the faceplate 28 away from the cover 18.

FIGS. 1-3 show the faceplate 28 overlapping the cover 18. In particular, the faceplate 28 overlaps at least a portion of the second section 31 of the cover 18. With the faceplate ferromagnetic elements 104 aligned with the cover ferromagnetic elements 136 as in FIGS. 1 and 2, the faceplate 28 will remain positioned on the cover 18, due to magnetic attraction between the faceplate ferromagnetic elements 104 and the cover ferromagnetic elements 136, until it is desired to re-orient the faceplate 28 at which time a user-provided rotation of the faceplate 28 with respect to the cover 18 will break the magnetic attraction between the faceplate ferromagnetic elements 104 and the cover ferromagnetic elements 136, to allow movement of the faceplate 28 to a new orientation with respect to the cover 18. The new orientation will re-align the faceplate ferromagnetic elements 104 with the cover ferromagnetic elements 136 at a different rest position of the faceplate 28 to secure the faceplate 28 to the cover 18. That is, each faceplate ferromagnetic element 104 will magnetically attract to any one of the cover ferromagnetic elements 136 such that the faceplate 28 can be repositioned to any orientation in which the faceplate ferromagnetic elements 104 overlap and align with the cover ferromagnetic elements 136.

Assembly of the information display system 12 may be as simple as aligning the opening 68 of the faceplate over the first section 30 of the cover 18. When placing the faceplate 28 on the cover 18, the magnetic attraction between the faceplate ferromagnetic elements 104 and the cover ferromagnetic elements 136 enable orientation of the faceplate 28 in any of the rest positions, however an operator can easily re-orient the faceplate 28 by rotating the faceplate 28 with respect to the first section 30. It should be noted that when the faceplate 28 is rotated, the magnetic attraction between the faceplate ferromagnetic elements 104 and respective cover ferromagnetic elements 136 would turn to magnetic repulsion. This feature may be advantageously used to easily remove the faceplate 28 from the cover 18. That is, as the faceplate 28 is rotated a certain number of degrees 150 away from a rest position, the faceplate 28 will be repulsed from the cover 18 at which point the faceplate 28 is easily removed from the cover 18. The faceplate 28 may then be rotated by the user with respect to the switching device 10 and replaced onto the cover 18 at a position on the cover 18 that allows easier reading by an operator and user. When the faceplate 28 is replaced on the cover 18, magnetic attraction between the faceplate ferromagnetic elements 104 and the cover ferromagnetic elements 136 will retain the faceplate 28 on the cover 18. The information 34 may be placed on the faceplate 28 at any point during the assembly of the information display system 12.

Different installation orientations of a switching device 10, including circuit breakers 14, can render a conventional fixed label inconvenient to read or scan. When a switching device 10 is installed, the fixed labels could be facing up, down, right or left with respect to an operator's field of vision from a normal standing, leaning, or sitting position of the operator, and as a result the operator may have some difficult reading or scanning the label if it is not installed in a manner that allows reading or scanning in a manner with which the language of information 34 is intended to be read, e.g. from left to right, left to right, and/or top to bottom. Thus, the information display system 12 provides a user with the opportunity to rotate the faceplate 28 with respect to the cover 18 and first section 30, which are fixed in relation to a remainder of the switching device 10, including the fixed orientation of the handle 26. Due to the properties of magnetic attraction and repulsion, the faceplate ferromagnetic elements 104 of the faceplate 28 may be moved away from the cover ferromagnetic elements 136 of the cover 18 with relatively little force in either the clockwise or counterclockwise directions 86, 88, allowing the faceplate 28 to be removed and repositioned to a desired orientation. The faceplate ferromagnetic elements 104 will again align with the cover ferromagnetic elements 136 when the desired orientation is selected such that the faceplate 28 cannot spin around inadvertently with respect to the cover 18. Furthermore, since the faceplate 28 may be provided with faceplate ferromagnetic elements 104 such as faceplate magnets 106, the faceplate 28 is easily magnetically securable to metallic surfaces such as, but not limited to, equipment panels. That is, the same faceplate 28 used for the switching device 10 may be used to transfer the information 34 on a metal equipment panel board, so that the faceplate 28 can be mounted on the equipment panel board if desired.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An information display system for a switching device having an operating handle, the information display system comprising:

a cover having a first side including an opening having the operating handle disposed therethrough, the cover first side defining a first section and a second section thereon, the first section defining a first longitudinal axis extending perpendicularly therethrough, the second section perpendicular to the first longitudinal axis; and a faceplate including an opening to receive the operating handle therethrough, selectively secured to the first side in one of a plurality of rest positions and configured to carry information about the switching device, wherein in each one of the plurality of rest positions, at least a portion of the second section of the cover is overlapped by the faceplate, at least a portion of the first section is aligned with the opening, and the operating handle is disposed through the opening;

wherein the faceplate is rotatable with respect to the cover about the first longitudinal axis.

2. The information display of claim 1, wherein each rest position corresponding to a different orientation of the information with respect to the cover, and the faceplate is magnetically attracted to the cover in each one of the plurality of rest positions.

3. The information display system of claim 2, wherein each one of the plurality of rest positions is spaced 90 degrees apart in either a clockwise or counterclockwise direction from an adjacent rest position amongst the plurality of rest positions.

4. The information display of claim 1, wherein the faceplate includes at least one faceplate ferromagnetic element, the cover includes at least one cover ferromagnetic element, and at least one of the at least one faceplate ferromagnetic element and the at least one cover ferromagnetic element is a permanent magnet.

5. The information display system of claim 4, wherein the faceplate is movable to align the at least one faceplate ferromagnetic element with the at least one cover ferromagnetic element in a first rest position of the faceplate with respect to the cover, and movable to align the at least one faceplate ferromagnetic element with the at least one cover ferromagnetic element in a second rest position of the faceplate with respect to the cover.

6. The information display system of claim 4, wherein the at least one faceplate ferromagnetic element is located on an interior surface of the faceplate, and the at least one cover ferromagnetic element is located on an interior surface of the cover, and an interior surface of the faceplate faces an exterior surface of the cover.

7. The information display system of claim 1, wherein the cover includes first and second opposite side edges, two cover magnets positioned adjacent the first side edge, and two cover magnets positioned adjacent the second side edge, and the faceplate includes at least one faceplate magnet.

8. The information display system of claim 7, wherein the faceplate is substantially square-shaped and includes four corners, and the at least one faceplate magnet is four faceplate magnets, each of the four faceplate magnets respectively located adjacent the four corners of the faceplate.

9. The information display system of claim 1, further comprising a label containing the information about the switching device, wherein the label is affixed to the faceplate.

10. The information display system of claim 1, wherein the first section includes a handle slot sized to allow passage of the handle of the switching device.

11. The information display system of claim 1, wherein the first section has a substantially circular shaped outer periphery, and the opening in the faceplate is substantially circular-shaped, wherein an outer diameter of the first section is larger than an inner diameter of the opening and the faceplate is rotatable with respect to the first section.

12. The information display system of claim 1, wherein the cover includes a handle slot, and the opening of the faceplate is sized to allow passage of a switching device handle therethrough.

13. The information display system of claim 1, wherein the first section includes a first shoulder wall having a substantially cylindrical shape and a first portion, the first portion offset from the second section of the cover.

14. The information display system of claim 13, wherein the first portion is substantially dome-shaped.

15. The information display system of claim 1, wherein the cover includes a shoulder wall including at least one detent and the faceplate includes at least one protrusion, wherein the at least one protrusion mates with the at least one detent when the faceplate is rotated away from the plurality of rest positions to assist in release of the faceplate from the cover.

16. A switching device comprising:

a handle;

a cover having a first side including an opening having the handle disposed therethrough, the cover first side defining a first section and a second section thereon, the first section defining a first longitudinal axis extending perpendicularly therethrough, the second section perpendicular to the first longitudinal axis; and a faceplate including an opening to receive the handle therethrough, selectively secured to the first side in one of a plurality of rest positions and configured to carry information about the switching device, wherein in each one of the plurality of rest positions, at least a portion of the second section of the cover is overlapped by the faceplate, at least a portion of the first section is aligned with the opening, and the handle is disposed through the opening;

wherein the faceplate is rotatable with respect to the cover about the first longitudinal axis.

17. The switching device of claim 16, wherein the faceplate and the cover are magnetically attracted to each other at any one of the plurality of rest positions.

18. The switching device of claim 16, wherein the switching device is a circuit breaker.

19. A method of displaying information on a switching device having an handle, the switching device having a cover having a first side including an opening having the handle disposed therethrough, the cover first side defining a first section and a second section thereon, the first section defining a first longitudinal axis extending perpendicularly therethrough, the second section perpendicular to the first longitudinal axis, the method comprising:

magnetically securing a faceplate including an opening to receive the handle therethrough to the switching device cover in a first position of the faceplate such that at least a portion of the second section of the cover is overlapped by the faceplate and at least a portion of the first section is aligned with the opening, the faceplate containing the information, the information oriented in a first orientation;

rotating the faceplate about the first longitudinal axis of the switching device cover; and, magnetically securing the faceplate to the switching device cover in a second position such that the operating handle is disposed through the opening, at least a portion of the second section of the cover is overlapped by the faceplate and at least a portion of the first section is aligned with the opening to re-orient the information in a second orientation different than the first orientation.

20. The method of claim 19 wherein rotating the faceplate includes breaking a magnetic attraction between the faceplate and the cover of the switching device, wherein the second position is a multiple of 90 degrees with respect to the first position.

21. The information display system of claim 1, wherein the first section protrudes from the second section.

22. The information display system of claim 1, wherein the faceplate further includes a ledge arranged for guiding rotation of the faceplate with respect to the cover.

23. The information display system of claim 16, wherein the first section protrudes from the second section.

24. The information display system of claim 4, wherein the at least one faceplate ferromagnetic element is of an opposite pole from the at least one cover ferromagnetic element.

25. The information display system of claim 13, wherein the second section comprises a second shoulder wall arranged to guide a rotational movement of the faceplate with respect to the cover about the first longitudinal axis.

* * * * *